US006463347B1

(12) United States Patent
Nevruz et al.

(10) Patent No.: US 6,463,347 B1
(45) Date of Patent: Oct. 8, 2002

(54) SYSTEM FOR DETECTING OCCURRENCE OF AN EVENT WHEN THE SLOPE OF CHANGE BASED UPON DIFFERENCE OF SHORT AND LONG TERM AVERAGES EXCEEDS A PREDETERMINED LIMIT

(75) Inventors: Albert A. Nevruz, Lawrenceville, NJ (US); Fred Y. Thomasson, Richmond Hill; Lysette H. Shuman, Savannah, both of GA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/254,822

(22) PCT Filed: Sep. 15, 1997

(86) PCT No.: PCT/US97/16336

§ 371 (c)(1),
(2), (4) Date: Jul. 8, 1999

(87) PCT Pub. No.: WO98/11415

PCT Pub. Date: Mar. 19, 1998

Related U.S. Application Data

(60) Provisional application No. 60/096,004, filed on Aug. 10, 1998.

(51) Int. Cl.[7] ..... G06F 19/00; G06F 3/00

(52) U.S. Cl. ..... 700/108; 700/67; 710/15

(58) Field of Search ..... 710/15, 18, 19; 702/1, 50, 51; 700/108, 110, 8, 9, 11, 28, 67

(56) References Cited

U.S. PATENT DOCUMENTS

| | | | | |
|---|---|---|---|---|
| 4,428,328 A | | 1/1984 | Ratliff | 122/396 |
| 4,462,319 A | | 7/1984 | Larsen | 110/238 |
| 4,497,283 A | | 2/1985 | LaSpisa et al. | 122/451.1 |
| 4,777,009 A | | 10/1988 | Singh et al. | 376/211 |
| 4,796,466 A | | 1/1989 | Farmer | 73/40.5 R |
| 4,811,389 A | | 3/1989 | Balch | 379/377 |
| 5,001,682 A | * | 3/1991 | Anderson | 367/186 |
| 5,148,775 A | | 9/1992 | Peet | 122/451 R |
| 5,159,682 A | * | 10/1992 | Toyonaga et al. | 716/10 |
| 5,320,967 A | | 6/1994 | Avallone et al. | 436/50 |
| 5,363,693 A | | 11/1994 | Nevruz | 73/40.5 R |
| 5,490,067 A | * | 2/1996 | Teguri et al. | 701/46 |
| 5,692,019 A | * | 11/1997 | Chang et al. | 375/347 |

FOREIGN PATENT DOCUMENTS

| | | | |
|---|---|---|---|
| JP | 05321773 A | * | 12/1993 |
| JP | 06142582 A | * | 5/1994 |
| JP | 08167842 A | * | 6/1996 |

* cited by examiner

*Primary Examiner*—Thomas Lee
*Assistant Examiner*—Thuan Du
(74) *Attorney, Agent, or Firm*—Synnestvedt & Lechner LLP

(57) ABSTRACT

A method and system are disclosed for detecting an occurrence of an event in a target system having at least one operational variable that provides an indication of one or mine conditions of the target system which change in response to the event. The method comprises the steps of: (a) periodically calculating short and long term averages of sequentially recorded values of the operational variable, the long term average including values in addition to those included in the short term average; (b) calculating the difference between the short and long term averages; and (c) determining the occurrence of an event based upon the difference by performing a statistical evaluation selected from the group consisting of determining the significance of the difference, monitoring a particular pattern of differences, monitoring change in the differences, and combinations of two or more thereof.

11 Claims, 6 Drawing Sheets

SYSTEM FOR DETECTING OCCURRENCE OF AN EVENT WHEN THE SLOPE OF CHANGE BASED UPON DIFFERENCE OF SHORT AND LONG TERM AVERAGES EXCEEDS A PREDETERMINED LIMIT

RELATED APPLICATION

This application claims the priority of provisional application No. 60/096,004 filed on Aug. 10, 1998.

BACKGROUND OF THE INVENTION

1. Field of the Invention

This invention relates broadly to monitoring systems. More specifically, this invention relates to a system and method for monitoring a dynamic system, such as a boiler or heat exchanger, which tends to undergo operational fluctuations, and for detecting quickly and accurately the occurrence of an event, such as a leak or lost efficiency, which may otherwise be masked or falsely implied by the operational fluctuations.

2. Background

The early detection of an event such as a leak or malfunction can be critical in many applications. As used herein, the term "event" broadly refers to an occurrence which impacts the normal operational of a particular system, and which, in many cases, tends to grow worse or more intense if left unattended. For example, in the case of black liquor recovery boilers used in the paper industry, detecting a leak in the boiler tubes early often is the difference between a controlled shut down and a catastrophic explosion. Such explosions not only result in the destruction of the boiler, but also frequently in severe injury and death.

Detecting the occurrence of a real and significant event in a system, particularly a complex system like a black liquor recovery boiler, poses a challenging task. Often such systems have many variables and their operation is subject to considerable, yet normal, changes and fluctuations. These normal operational changes and fluctuations tend to mask events or create the false appear of one. Therefore, a monitoring system for detecting the occurrence of an event must be able to filter out these normal fluctuations, but nevertheless remain sensitive enough to provide an early indication of an event.

In the case of recovery boilers, methods to detect water leaks have been proposed and tested by researchers for several years. Most leak detection schemes monitor the total airborne or structural acoustic energy levels within the boiler to determine if a leak is present. Such acoustic leak detection strategies, however, face significant limitations. These limitations include the interference presented by high background noise levels, the attenuation of acoustic energy occurring within the boiler, and the limited durability of acoustic sensors in the harsh environment of the boiler.

A more recent improvement of acoustic leak detection systems, developed by Westvaco Corporation, utilizes spectral analysis techniques (*TAPPI Journal* (July 1990)). While the Westvaco system appears to be an improvement over previous acoustic leak detection systems, it still, to some extent, is subject to the above-identified disadvantages of acoustic leak detection technology. Moreover, spectral-analysis, acoustic leak detection systems tend to be expensive to purchase, implement and maintain.

A difference approach to leak detection system, which was introduced by the Applicant in U.S. Pat. No. 5,363,693, detects a leak by striking a mass balance around the recovery boiler. By measuring the fluid flowing in to and out of the recovery boiler system, fluid leakage loss based on the difference between the input and output can be calculated. If the difference is determined to be significant, a leak is indicated.

Although this leak detection system represents a marked improvement over existing acoustic methods, an on-going need exists to improve the sensitivity and reliability of a leak detection system. Moreover, the Applicant perceives a general need for a system that can quickly and accurately detect an occurrence of an event or significant change in all types of dynamic systems which undergo normal fluctuations. The present invention fulfills these needs among others.

SUMMARY OF THE INVENTION

The present invention provides for the early and accurate detection of an event or significant change in a target system by monitoring and statically evaluating at least one operational variable of the target system. The operational variable may be related to mass, volume, energy, momentum, time, money, quality, or any other quantitative measurement or calculation that provides an indication of one or more conditions of the target system which change in response to the event. The operational variable is evaluated by periodically averaging its values over relatively short and long terms. By comparing the long and short term averages using convenient, readily-implemented statistical techniques, the occurrence of an event can be determined with a high degree of confidence despite the target system's normal fluctuations.

One aspect of the present invention is a method for detecting an occurrence of an event in a target system. In a preferred embodiment, the method comprises the steps of: (a) calculating short and long term averages of sequentially recorded values of an operational variable wherein the long term average includes at least one values in addition to those included in the short term average; (b) calculating a difference, Δ, between the short and long term averages; and (c) statistically evaluating whether Δ is significant and indicative of an event occurrence.

In one embodiment, the statistical evaluation of step (c) comprises an analysis of Δ to determine its significance given the number of values considered in the averages and the variation between the values. The reliability of the indication is increased by repeatedly calculating whether a significant Δ exists. As the number of sequential significant Δs increases, so does the certainty that an event has occurred.

A preferred technique for determining the significance of A comprises calculating $t_{test}$. This calculation provides an important correlation between the sampling size and the certainty that a Δ is real as opposed to just a random anomaly or "noise."

In another embodiment, the statistical evaluation of step (c) comprises an analysis of the change in a over time. By analyzing the dynamics of Δ, a trend indicative of the event can be determined well before the event's full effect is realized by static measurements. In other words, the present invention anticipates an event based upon the trend of Δs, rather than waiting until Δ reaches a predetermined limit. This approach not only shortens the time in which an event can be determined over prior art methods, but also improves the accuracy of such determinations and reduces the occurrence of false positive alarms.

The dynamic analysis mentioned above may be performed by repeating steps (a) and (b) at least once, wherein the short and long term averages include at least one value more recent than any values considered in a previously calculated short and long term average, and then calculating the change in Δ over the change in sequence of the recorded values. If the change in Δ exceeds a predetermined value, then the occurrence of an event is likely.

Another aspect of the present invention is a system for detecting an occurrence of an event in a target system. In a preferred embodiment, the system comprises a central processing unit (CPU), user interface means operatively connected to the CPU for inputing the target system's operational variable(s) and for outputing an indication of an occurrence of an event, and memory which contains a program of instructional means for the system to perform the above-mentioned process. The system may also comprise measurement means for measuring the target system's inputs and outputs.

Still another aspect of the present invention is a computer readable medium, such as a floppy disk or CD ROM. The computer readable medium contains a program of instructional means for the above-mentioned system to perform the above-mentioned process. In accordance with the present invention, the method and system provided enable a user to monitor a dynamic system which tends to undergo operational fluctuations, and to detect quickly and accurately the occurrence of a significant event which may otherwise be masked or falsely implied by the operational fluctuations. Applications for the present invention are widespread and include, for example, monitoring a mass balance around a boiler to detect a leak; monitoring the heat transfer of a heat exchanger to detect excess scale build up; monitoring a motor's power consumption to detect bearing failure; monitoring overtime to detect an under-staffing condition; monitoring service calls to detect a defective product; and monitoring quality on an assembly line to detect low moral. Indeed, the present invention can be applied to any target system or situation having at least one operation variable that changes in response to an event.

DETAILED DESCRIPTION OF THE PRESENT INVENTION

The present invention provides a system and method for quickly and accurately detecting the occurrence of an event in a target system. The present invention may be practiced on any target system having one or more operational variables that change in response to an event occurring in or around the target system. Suitable target systems include, for example, apparatus such as boilers, heat exchangers, or reactors; combinations of components such as electrical distribution systems, fresh water cooling systems, or assembly lines; and even personnel such as a sales department, clerical staff, or city population.

Figure 1:
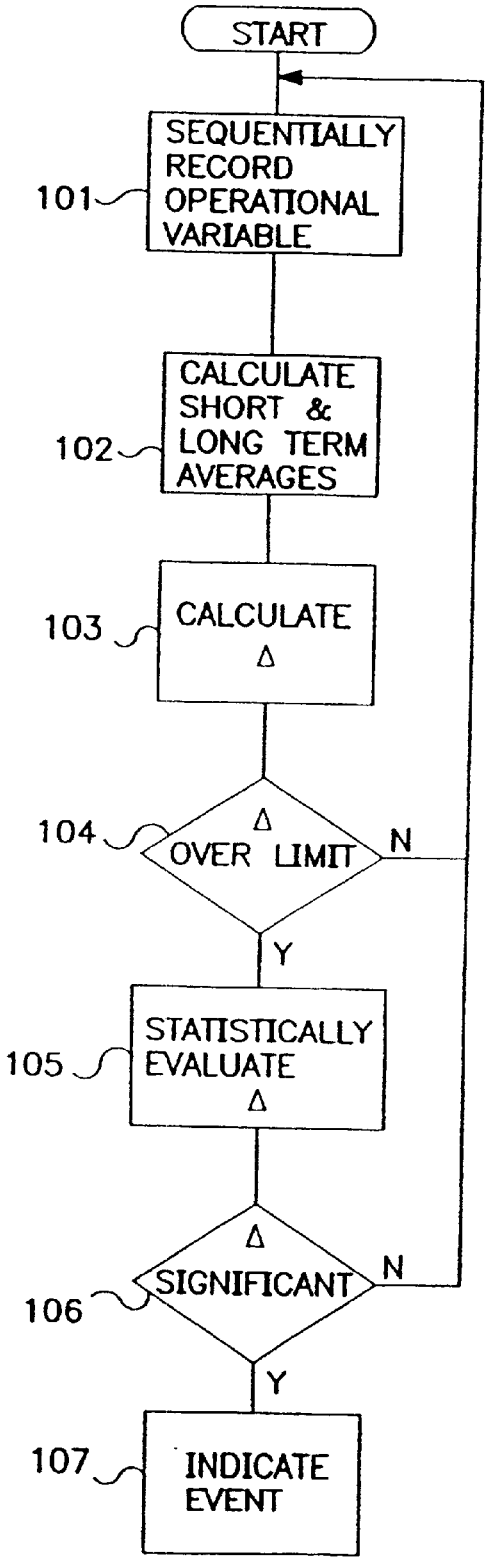
FIG. 1 is a flow chart depicting a preferred process embodiment of the invention.

A process embodiment of the invention is depicted in FIG. 1 as a flow chart. Referring to that figure, in Block 101, operational variable values are periodically measured or calculated and recorded sequentially. Block 102 then calculates and records short and long term averages for these values. The short and long term averages are moving averages of the operational variable values, and are typically recalculated once a new operational variable value is recorded. The short term average is based upon a sampling size which is a fraction of the sampling size used for the long term average. In Block 103, the difference between each corresponding set of short and long term averages, herein "Δ", is determined. In a preferred embodiment, Block 104 determines if Δ is over a predetermined limit. This step avoids unnecessary statistical evaluation in Block 105 if Δ is insignificant. If Δ does exceed a predetermined limit or if the optional Block 104 is not employed, then the process proceeds to Block 105 where the short and long term averages are evaluated using statistical techniques to determine whether Δ is real and significant and, therefore, indicative of an event. The statistical evaluation techniques used in this process represent an important aspect of the invention and are considered in more detail below. After evaluation, if Δ is determined not to be significant in Block 106, the interrogation of a particular Δ ends. If Δ is significant, then Block 107 indicates the probable occurrence of an event.

Figure 2:
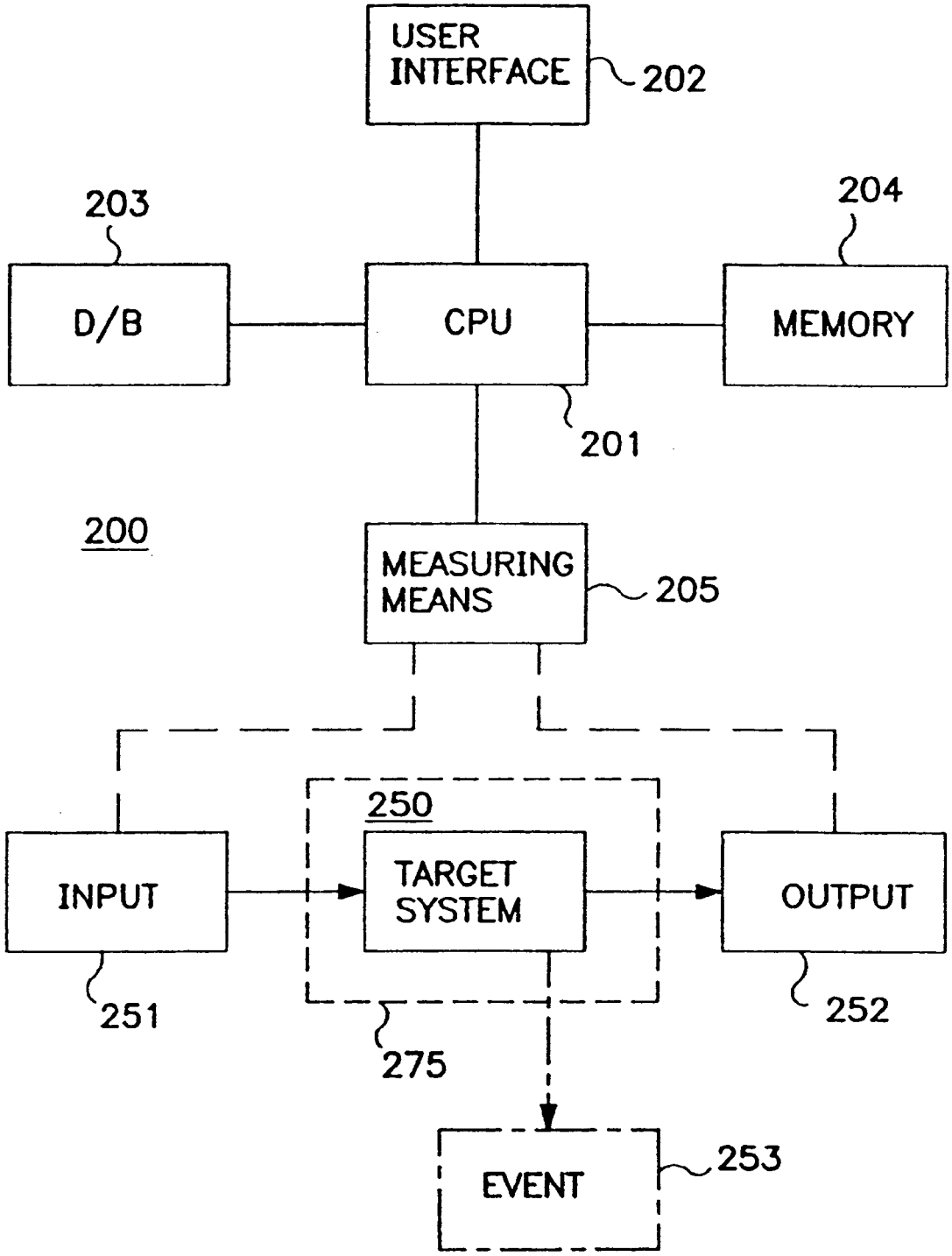
FIG. 2 is a schematic diagram of a preferred system embodiment of the invention.

A system embodiment of the invention is depicted schematically in FIG. 2. As shown, a system 200 comprises a central processing unit (CPU) 201 which may be a discrete processor, or a combination of processors, configured in a personal computer, controller, work station, main frame or the like. Such CPUs are known in the art. operatively connected to the CPU 201 is a user interface 202. The user interface may contain input means, such as a mouse or keyboard, which enables the user to input information into the system 200. It may also include output means, such as a display monitor, printer or audio alarm mechanism, which provides the user with an indication of the system's output. The system 200 may also comprise measurement means 205 operatively connected to the CPU 200. The measurement means 205 measures one or more operational variables of a target system 150. In the embodiment depicted in FIG. 2., the target system 150 has an input 151, an output 152, and a potential event 153 (phantom line) which may be an unaccounted for leak, waste, or inefficiency. It should be noted that measurement of an operation variable may be performed by equipment outside the system of the present invention and provided to the CPU 201 by means known in the art. Also operatively connected to the CPU 201 is memory 204 which contains a program of instructional means for the system 200 to perform the process of the present invention as described above. Memory 204 can be any known memory medium such as RAM or PROM.

The program of instructional means may be integral to the system of the present invention or a discrete aspect of the present invention. The program may be adapted to function on known operating platforms and is anticipated to be compatible with emerging operating platforms as well. The program may be stored on any computer readable medium such as a disk, tape, CD ROM, RAM or PROM.

Figure 3:
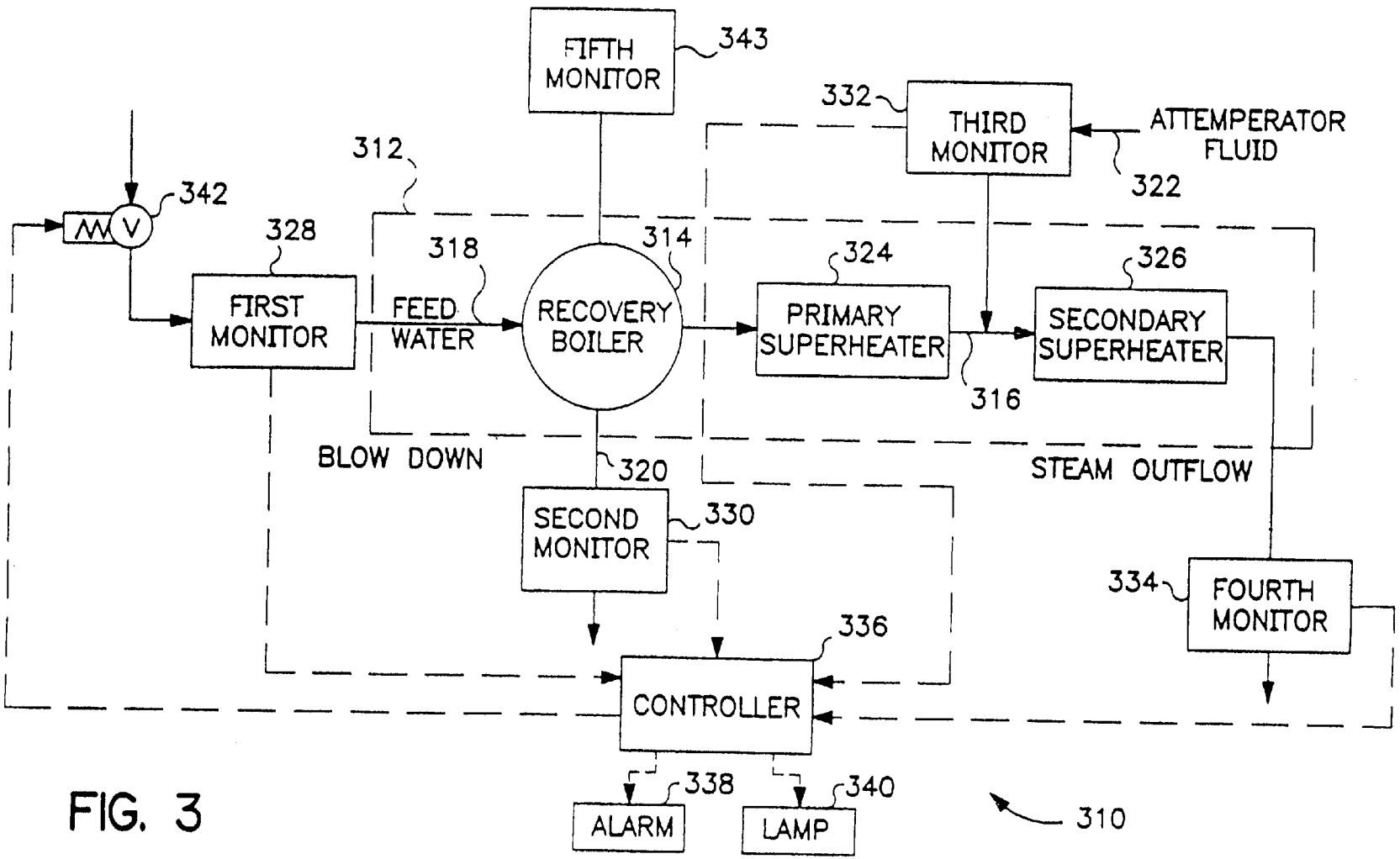
FIG. 3 is a schematic diagram of a preferred embodiment of the system applied to a chemical recovery boiler.

A particular embodiment of the system of the present invention as applied to a chemical recovery boiler is shown in FIG. 3. Referring to that figure, a system 310 for detecting leakage from a chemical recovery boiler system 312 of the type which includes a recovery boiler drum 314 and associated steam output piping 316 is shown. Recovery boiler system 312 typically includes a feed water line 318 for supplying water to the recovery boiler drum 314 and an outlet line 320 for "blow-down" flow. Boiler system 312 further includes steam output piping 316, which typically leads to a turbine for electricity generation. An inflow line 322 for introducing attemperator fluid, usually water, into the steam piping 316 is also illustrated in FIG. 3. The purpose of the attemperator fluid is to cool down steam which has been heated beyond a predetermined level. Primary and secondary superheaters 324, 326 may also be positioned in the steam output line 316.

The system 310 according to the preferred embodiment of the invention includes a first monitor 328 that interposed within the feed water line 318 for measuring the mass flow of feed water into the recovery boiler drum 314. A second monitor 330 is interposed in the blowdown output line 320 for measuring the mass flow of blow-down which may be expelled from the recovery boiler drum 314. A third monitor 332 is interposed in the attemperator fluid inflow line 322 for measuring the mass flow of attemperator fluid into the steam output piping 316. A fourth monitor 334 is provided in the outflow portion of steam piping 316 for measuring the mass output from the steam piping 316. A fifth monitor 343 is operatively connected to the boiler drum 314 for measuring the level of fluid in the drum, herein referred to as the "drum level". The monitors 328, 330, 332, 334, and 343 are all preferably electronic in nature, and all are constructed and arranged to report electronically to a controller 336, as is schematically depicted in FIG. 3.

The process of the present invention is addressed below in greater detail and in regard to a specific target system, namely, the chemical recovery boiler as described above. It should be understood, however, that the process may be applied to any target system having one or more operational variables that change upon the occurrence of an event.

Recordation of Operational Variable Values

The first step involves sequentially recording values of one or more operational variables of the system. As mentioned above, the operational variable may be related to mass, volume, energy, momentum, time, money, quality, or any other quantitative measurement or calculation that provides an indication of one or more conditions of the target system which change in response to the event. In a preferred embodiment, the operational variable relates to a system balance which may be calculated by equating inputs to outputs. For example, the input may be raw materials, energy, water, steam, etc, and the output may be a finished product, steam, energy, etc. In a simple target system, there is a one to one correspondence between input operational variables and output operational variables, meaning units going in directly correspond to unit going out, e.g., gallons of water in/gallons of water out. In a more complicated target system, the input and output must be equated. For example, an input of a certain amount of water and energy corresponds to an output of steam at a certain pressure and temperature. Equating such inputs and outputs is known in the art.

Referring to FIG. 3, during operation of the recovery boiler system 312, the monitors 328, 330, 332, 334 report continuously to controller 336, which samples such data periodically, preferably about every second. From this data, controller 36 calculates a system balance, which in this case is the drum balance (DB) expressed in units of mass per unit time. This calculation, depicted as Block 101 in the flow chart illustrated in FIG. 1, may be expressed as follows:

$$DB = \text{Feed Water Flow} + \text{Attemperator Flow} - (\text{Steam Flow} + \text{Blow Down Flow}) \quad \text{Equation (1)}$$

According to a preferred embodiment of the invention, the accuracy of detecting a significant change in a system balance can be improved by compensating for normal fluctuations within the system. To this end, a relationship is struck between the system balance and one or more operational variables that to impact it. The correlation between the operational variable(s) and the system balance can be used to generate a correction or compensation factor that can be applied to the system balance to correct expected fluctuations.

For example, in a chemical recovery boiler, the drum balance calculation is improved by compensating for the swelling and shrinking of the boiler drum 14 caused by pressure changes in the system 10 and other factors. The swelling and shrinking of the boiler drum can conceal or suggest a leak erroneously. That is, when a boiler swells, its volume increases and retains more fluid. This gives the indication that the amount of fluid entering the boiler is less than the fluid exiting, which therefore suggests a leak. Conversely, when the boiler shrinks, its capacity is diminished. This results in increased fluid relative to the boiler system. If a leak exists, the increased fluid may serve to mask it since the fluid output may not change or may even increase vis a vis the fluid input. Therefore, a more accurate drum balance can be calculated by compensating for boiler shrinking/swelling.

To this end, the present invention draws a relationship between drum balance and drum level. It has been found that drum level provides a simple and accurate correlation to drum balance (although other variables such as system pressure and temperature can be used individually or in combination to provide an indication of drum balance). Theoretically, the drum level and drum balance should be mirror images of one another—as the drum balance increases and decreases, drum level should drop and rise respectively. Based on this relationship, the controller 334 receives a signal from monitor 343 and calculates a compensated drum balance ($DB_C$) using the following equation:

$$DB_C = DB - DB_P \quad \text{Equation (2)}$$

wherein DB is calculated according to Equation (1), and $DB_P$ is the compensation factor based on drum level. The compensation factor has the following correlation equation:

$$DB_P = a + DL * b \quad \text{Equation (3)}$$

wherein a is a moving intercept, b is a moving slope for a particular set of data, and DL is the drum level.

In one embodiment, the correlation equation is generated using neural network logic. Neural systems are known in the art and can train themselves to predict process behavior using on-line data. Using neural lines correlation techniques therefore enables the compensation factor to be updated periodically, for example, every second, to account for fluctuations caused by boiler swelling and shrinking in the drum balance, thereby minimizing erroneous measurements. Although neural networks provide a powerful tool to predict output, it should be understood that other conventional correlation techniques can be used. Moreover, it is anticipated that future correlation techniques used to predict one variable based on another variable, or a group of variables, will find application in this leak detection system.

Calculation of Short and Long Term Averages

The present invention uses a comparison of long term sampling and short term sampling in its statistical evaluation of one or more operational variables. More specifically, a long term moving average of a operational variable is calculated over a particular time frame or "window." The window contains a particular sampling size of sequentially recorded values of an operational variable. The sampling of data in this window changes as new operational variable values are recorded. These new values enter the window while older values leave. A short term moving average of the operational variable is calculated over just a portion of this window.

Averaging data is well known in the art and any known technique may be practiced within the scope of this invention. In the chemical recovery boiler, for example, controller 336 uses long term sampling and short term sampling in its statistical analysis of the data received from the monitors 328, 330, 332, 334. As represented below in equation (4) and (5), controller 336 calculates short term and long term drum balance averages $\overline{DB_1}$ and $\overline{DB_2}$ periodically, for each data sampling, wherein Ts represents current time in seconds, $N_1$ represents the number of samples included in the short term average, and $N_2$ refers to the number of samples included in the long term average:

$$\overline{DB_1} = \frac{\sum_{i=T_s-N_1}^{N_1} DB(i)}{N_1} \quad \text{Equation (4)}$$

$$\overline{DB_2} = \frac{\sum_{i=T_s-N_2}^{N_2} DB(i)}{N_2} \quad \text{Equation (5)}$$

Rather than relying on a single window, a preferred embodiment of the present invention uses a plurality of windows of varying duration or sampling size. Each window corresponds to a pair (herein "window pair") of short and long term averages.

Multiple window pairs allow the system and method of the present invention to strike a balance between responsiveness and accuracy. A window pair taken over a relatively short time frame allows for a relatively quick indication of a leak. However, the risk of a false alarm is greater due to the relatively small data sampling failing to transcend an otherwise benign system fluctuation. on the other hand, a longer time frame involves a greater sampling size and tends to reduce the effects of transient fluctuations. The cost of such accuracy, however, is decreased response time. Therefore, the present invention provides for a variety of time frames to satisfy response time and accuracy needs.

Figure 4:
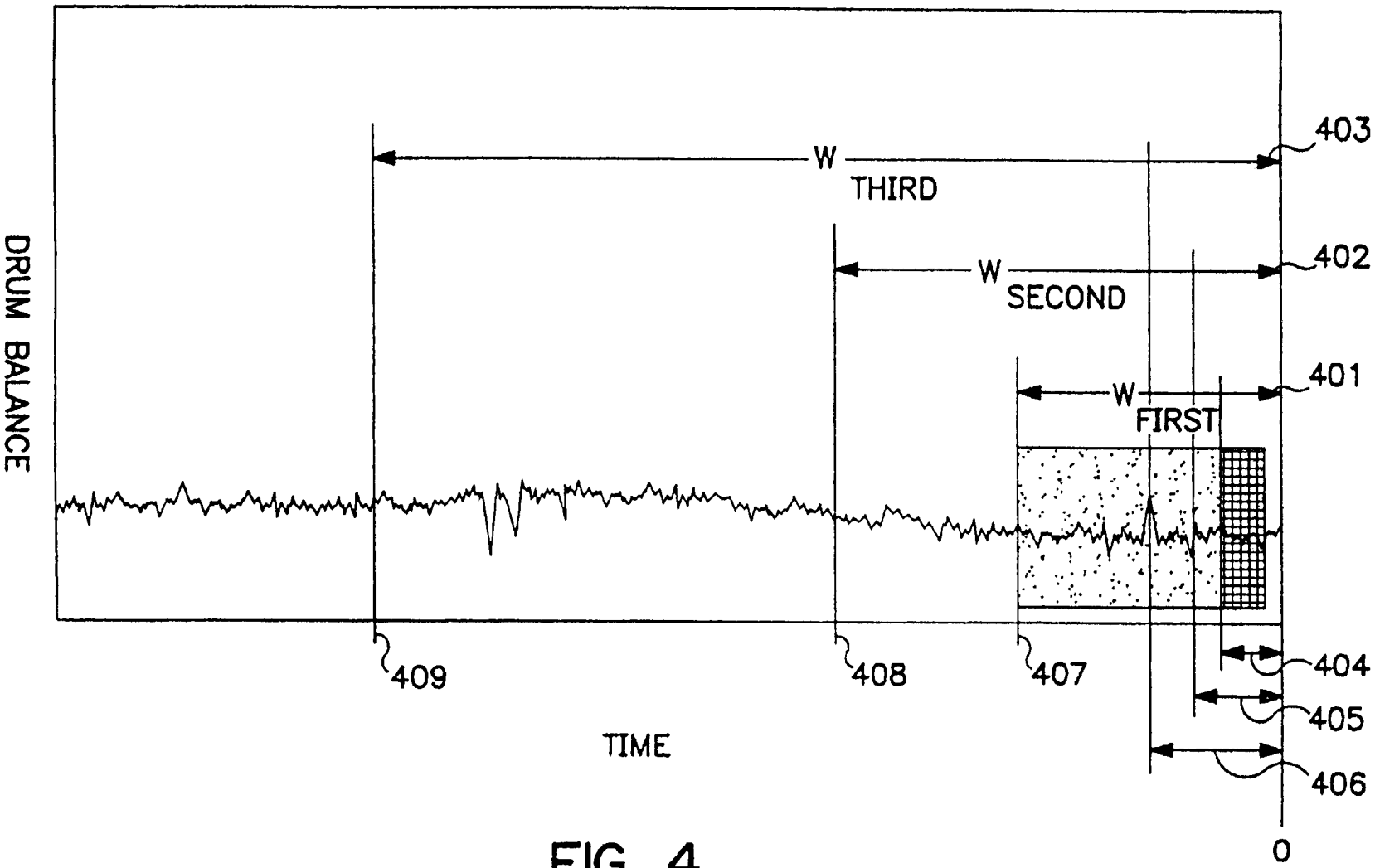
FIG. 4 is a chart showing drum balances over time in relation to various time frames.

An example of a multiple window pair system for a recovery boiler system is shown in FIG. 4. That figure depicts drum balance data over time in relation to a leak detection system having three independent window pairs—a first pair 401, a second pair 402, and a third pair 403. The right side of the chart indicates time zero or present time, and towards the left side of the chart, the drum balance data becomes more dated. It should be apparent from the depiction of FIG. 4 that with every update, new drum balance datum enters the window pairs simultaneously from the right, while various older drum balance data exit the window pairs to their left. The duration that a particular drum balance datum remains in a window pair depends entirely on the window size.

The first window pair 401 corresponds to a short term average drum balance that extends back in time for a short term 404. The short term average drum balance of the second window pair 402 extends back in time for a short term 405 which is longer than the short term 404. Likewise, the third window pair 403 corresponds to a short term average drum balance that extends back in time for a short term 406 which is longer yet than that the short term 405. The long term average drum balances corresponding to the first 401, second 402, and third 403 window pairs extend back for long terms 407, 408, and 409 respectively.

The short term over which a particular short term average is calculated, or, in other words, the number of data considered, preferably relates to the cyclic tendency of the system being monitored. Due to various operating conditions, for example, pumps turning on/off and changing steam demands, a given operational variable tends to cycle. It is therefore preferred that the short term averages be taken over a period corresponding to a portion of the cycle that roughly provides a range of operational variable value magnitudes expected to occur in a typical cycle, for example, a quarter cycle. In this way, the short term average includes both cyclic highs and lows, and consequently, tends to avoid false leak indications caused by ordinary cycling.

The cycle can be determined either by examining the system data over time or, preferably, by calculating it online in the system CPU using contemporaneous recorded data. The latter can be undertaken using known correlation or curve fitting software. By having the operational variable cycle updated continuously in the CPU, the system can adjust the short term drum balance averages to cover relevant portions of the cycle as the cycle itself varies.

The long term over which a particular long term average is taken depends in part upon the short term of its paired short term average. That is, the long term average should be long enough to transcend operational conditions affecting the short term average, but not so long as to average out all drum balance anomalies. As used in this disclosure, R refers to the ratio of $N_2$ divided by $N_1$. It has been found that a preferred R or the ratio of $N_2$ to N, is about 8:1 to about 12:1, and, more preferably, about 10:1. Moreover, with particular regard to longer time frames, it may be beneficial to extend the long term average beyond a typical work shift. This way, operational differences between different shifts can be averaged out thereby reducing the likelihood of a false positive alarm signal.

Referring back to FIG. 4, the first 401, second 402 and third 403 window pairs have short terms corresponding to approximately one quarter, one half and a full boiler cycle respectively. The long terms are approximately ten times as long. Thus, in a system with a drum balance cycle of approximately 40 minutes, controller 336 conducts short term averaging over 10, 20, and 40 minute terms for the first, second and third time frames respectively. The long term average drum balances would be calculated over approximately 100, 200, and 400 minute terms for the first, second, and third time frames respectively. It may be beneficial to extend the long term of the third time frame to approximately 600 minutes, or so, to span between multiple operation shifts. For the first window pair, $N_1$ and $N_2$ would be 120 and 1200 respectively for sampling every 5 seconds. The numbers of drum balance data used in the second and third time frames would be calculated in a similar manner.

Determination of Excessive Δ

After calculating long and short term value averages of a operational variable, the CPU calculates the difference (herein "Δ") between them in Block 203 to determine the possibility of an event. If Δ does not exceed a maximum tolerable difference, $\Delta_{max}$, then the process waits until the long and short term averages are updated and recalculates Δ. If $\Delta_{max}$ is exceeded, however, Δ may be indicative of an event, and the process proceeds to Block 205. $\Delta_{max}$ may be determined empirically based upon the desired sensitivity of the system and method. It should be understood that although determining the significance of Δ before embarking on its statistical evaluation is preferable from the standpoint of conserving computer resources, it is not required.

In the case of the recovery boiler, for example, controller 336 calculates Δ between the short and long term average drum balances $\overline{DB_1}$ and $\overline{DB_2}$ for each window pair for each sampling period using the following calculation:

$$\Delta=\overline{DB_1}-\overline{DB_2} \qquad \text{Equation (6)}$$

In Block 204, the controller 336 next compares Δ with a predetermined maximum limit $\Delta_{max}$ as described above. A Δ in excess of $\Delta_{max}$ may be indicative of a leak.

Statistical Evaluation of Δ

An essential aspect of the present invention is determining whether Δ is "real" and indicative of an event, such as a leak. To this end, the present invention employs a variety of statistical techniques, individually and in combination. These techniques include but are not limited to the following:

a. Determining the significance of Δ, b. Monitoring a particular pattern of significant Δs, and c. Monitoring change in Δ.

a. Determining the Significance of Δ

One approach in evaluating Δ is to determine if it is significant given the variations in the sample data and the size of the sample. A preferred technique for determining this is calculating $t_{test}$. Those skilled in the art of statistics will recognize that $t_{test}$ provides an important correlation between the sampling size and the certainty that a Δ is real as opposed to just a random anomaly or "noise."

Figure 5:
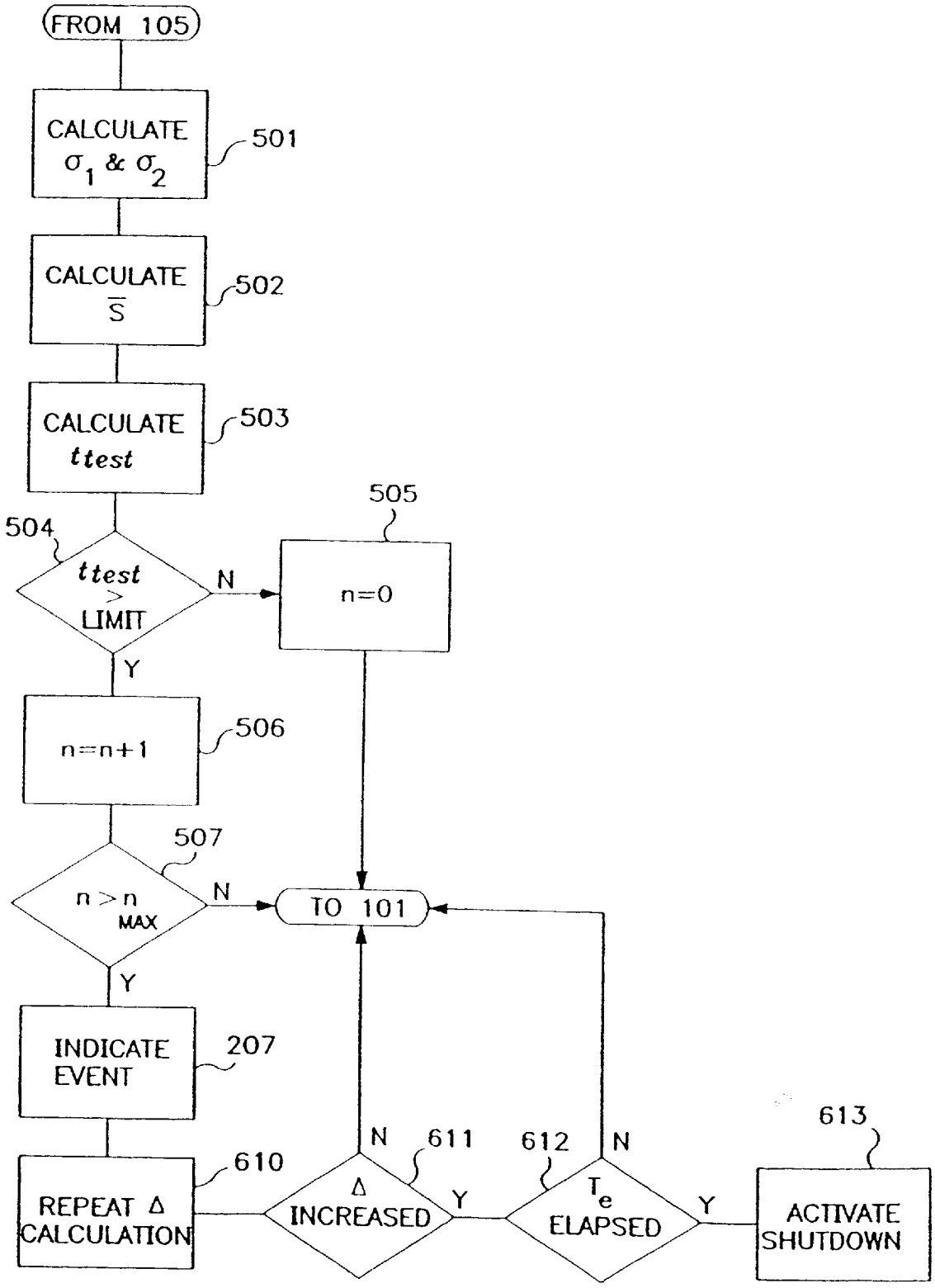
FIG. 5 is a flow chart of a preferred process embodiment of the invention in which a pattern of significant As are monitored.

A flow chart of processes involving the calculation and use of $t_{test}$ is shown in FIG. 5. Determining $t_{test}$ requires calculating the pooled standard deviation of the long and short term averages in Block 501. Such a calculation is well known in the art. For example, the controller 336 may first calculate the standard deviations $\sigma_1$, $\sigma_2$ for the short and long term samples of each window pair, respectively, using equations (7) and (8):

$$\sigma_1 = \sqrt{\frac{\sum_{i=T_s-N_1}^{N_1} (DB(i) - \overline{DB_1})^2}{N_1 - 1}} \qquad \text{Equation (7)}$$

$$\sigma_2 = \sqrt{\frac{\sum_{i=T_s-N_2}^{N_2} (DB(i) - \overline{DB_2})^2}{N_2 - 1}} \qquad \text{Equation (8)}$$

In Block 502, the controller 336 then calculates the pooled estimated standard deviation $\overline{S}$ for the entire data set for each time frame 204 using the following equation:

$$\overline{S} = \sqrt{\frac{(N_1 - 1)\sigma_1^2 + (N_2 - 1)\sigma_2^2}{(N_1 - 1) + (N_2 - 1)}} \qquad \text{Equation (9)}$$

In Block 503, the significance of Δ for each time frame is determined using $t_{test}$, which may be calculated in any manner known in the art. For example, the controller 336 may calculate $t_{test}$ using the following equation:

$$t_{test} = \frac{\overline{DB_1} - \overline{DB_2}}{\overline{S}\sqrt{\frac{1}{N_1} + \frac{1}{N_2}}} \qquad \text{Equation (10)}$$

In Block 504, the CPU determines whether $t_{test}$ exceeds a predetermined maximum, $t_{max}$. If $t_{max}$ is exceeded, then Δ is considered to be significant at a corresponding confidence limit. In one embodiment of the invention, the controller 336 signals an alarm in Block 107 (FIG. 1) if the $t_{max}$ was exceeded.

b. Monitoring a Pattern of Significant Δs

To improve the accuracy of determining the occurrence of an event, significant Δs (as calculated by $t_{test}$, for example) are monitored to determine if a predetermined limit is exceeded. This predetermined limit is user defined and may include a given number of significant Δs over a certain period, a particular pattern of significant Δs, or a predetermined succession of significant Δs. Of these, a predetermined limit of consecutive significant Δs is preferred.

A succession of significant Δs in the average drum balances offers a higher degree of reliability that a leak actually exists than just one occurrence. By analogy, flipping a coin just once and having it land heads-up indicates very little about its tendency to be fair and land either heads-up or heads-down with equal probability. If, on the other hand, a coin is flipped repeatedly and continues to land heads-up, the likelihood that the coin is not fair increases exponentially as the succession of heads-up landings increases.

By increasing the reliability of an alarm condition, the improved system offers two distinct advantages over the prior art. First, higher reliability equates to fewer false alarms. False alarms may not only precipitate a costly shut-down, but also "desensitize" the operators causing them to react indifferent to a real leak. Second, higher reliability allows for a more sensitive system. That is, since the chance of a false alarm is greatly diminished, the $t_{max}$ can be lower. It need not be maintained at a relatively high level to act filter for peak normal values.

Referring back to FIG. 5, one preferred embodiment of the invention is shown for monitoring a pattern of significant Δs in a recovery boiler. If $t_{test}$ is not greater than $t_{max}$ in Block 504, then controller 336 resets the number or the indicator of consecutive significant Δs (n) to zero in Block 505, and waits to repeat the above-described calculations with respect to the data which is received from the sensors 328, 330, 332, and 334 in the next sampling period. On the other hand, if $t_{test}$ is greater than $t_{max}$, controller 336 increases the number of significant Δs by one in Block 506, and then determines whether a predetermined succession of significant Δs has been reached in Block 507. If the number of significant Δs is reached, an alarm 338 is signaled in Block 207.

C. Monitoring Change in Δ

Another statistical techniques for determining the significance of Δ is evaluating the dynamics of Δ as new operational variable values are periodically recorded. An event, such as a leak, will produce a predictable Δ slope over time. By monitoring Δ slope, a highly reliable determination can be made as to the occurrence of an event.

Figure 6:
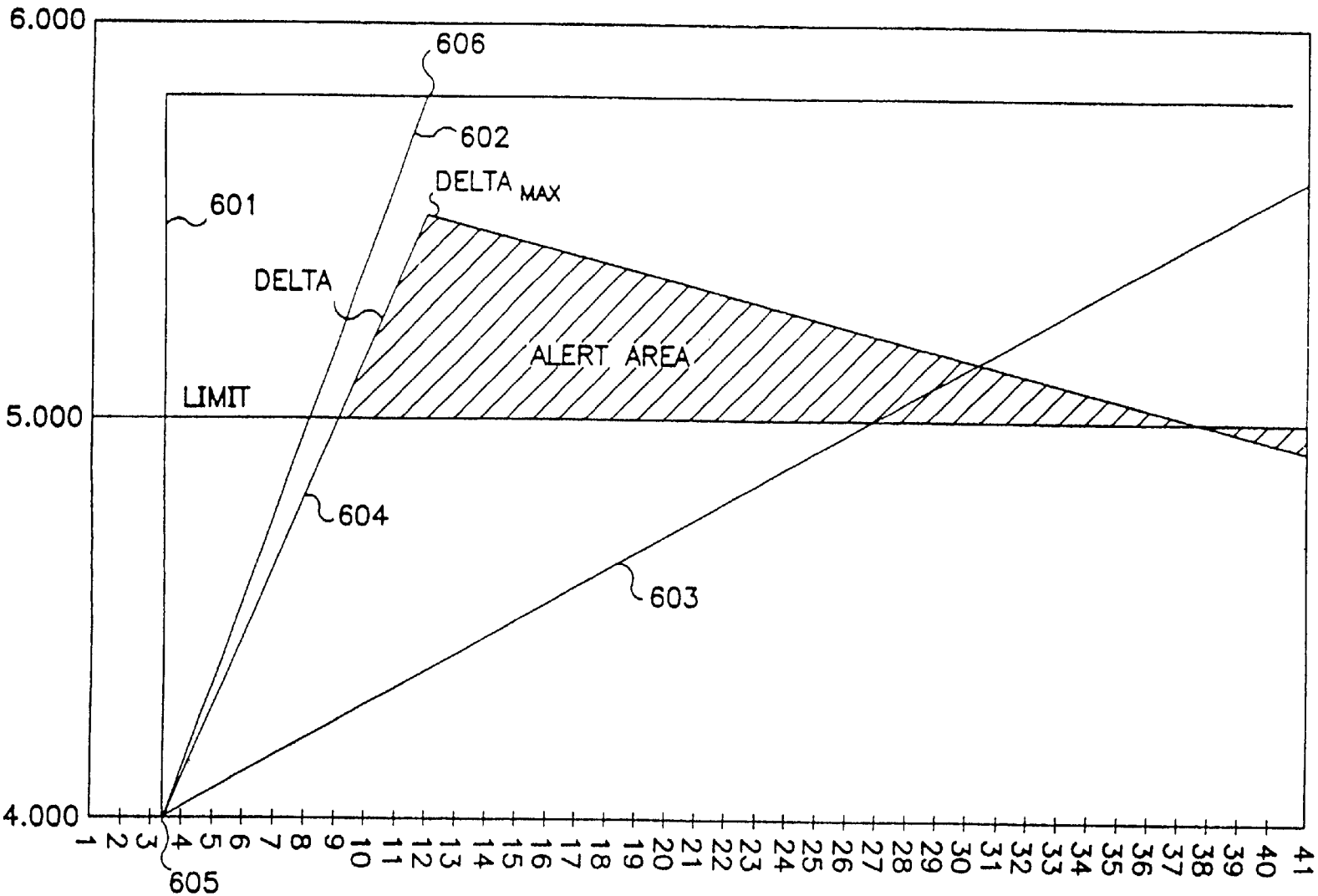
FIG. 6 is a chart of values of system balances as a function of sequential recordings.

FIG. 6 shows a graphical representation of recorded values of an operational variable, in this case a system balance 601, as a function of time or sequential recordations. The figure also shows short term average system balance 602, long term balance average system balance 603, and Δ 604 as system balance are periodically recorded. Although system balance is represented in FIG. 6 and the following equations, it should be noted that any operational variable may be similarly used.

An event at the origin 605 causes the initial system balance $SB_O$ to increase sharply to $SB_E$ 606. As a result, the short term average begins to increase at a rate of $SB_E/N_1$, where $N_1$ is the number of system balances considered in the short term average. The short term average increases until reaching its maximum at a point equal to $N_1$ after the event. The long term average increases at a lower rate of $SB_E/N_2$ where $N_2$ is the number of system balances considered in the long term average. In similar fashion to the short term average, the long term average increases until reaching its maximum at a point equal to $N_2$ after the event. After such time, $SB_1$ is considered in all the system balances used in both the short and long term averages and Δ is minimized.

The difference in the rate of increase between the short and long term averages produces a Δ with a characteristic slope. As a result of the event, Δ increases with a slope having the following equation:

$$SLOPE_{\Delta_{theoretical\ up}} = \frac{\frac{N_2 - N_1}{N_2} * SB_E}{N_1} \qquad \text{Equation (11)}$$

The slope of Δ continues to increase according to Equation 11 for a period equal to $N_1$, at which point, Δ reaches its maximum value. Then, Δ begins a slow decrease with a slope having the following equation:

$$Slope_{\Delta_{theoretical\ down}} = \frac{\frac{N_2 - N_1}{N_2} * SB_E}{N_2 - N_1} \qquad \text{Equation (12)}$$

This slope lasts until reaching a steady state after a period equal to $N_2$ from the point of the event.

The present invention recognizes the dynamic relationship between Δ and the occurrence of an event. Based on this relationship, a preferred embodiment of the present invention plots Δs as a function of the periodic calculation of system balances to provide an indication of an occurrence. Once Δ exceeds a predetermined limit as described in Block 106 above, is the positive slope of Δs (herein "$slope_{\Delta up}$") is calculated. The calculation of $slope_{\Delta up}$ may be performed using any known slope calculation means. In one preferred embodiment, $slope_{\Delta up}$ is calculated in accordance with the follow formula:

$$Slope_{\Delta_{up}} = \frac{\Delta_i - \Delta_o}{N_i - N_o} \qquad \text{Equation (13)}$$

In this equation, $N_o$ represents a point in time or other sequential index identifying a corresponding recordation of an operational variable value just prior to the occurrence of an event. $N_o$ correlates to $\Delta_o$ which represents the calculated difference between the short and the long term just prior to the occurrence of an event. In a preferred embodiment, $N_o$ and $\Delta_o$ are the N and Δ values just prior to Δ exceeding $\Delta_{max}$. $N_i$ and $\Delta_i$ respectively represent the sequential index and Δ pertaining to a particular recorded value. Aside from Equation 13, other, conventional curve fitting software may be employed to determining Δ slope, such as least squares. The $slope_{\Delta up}$ is compared to a slope limit or $slope_{\Delta up\ max}$. If the value of the slope equals or exceeds $slope_{\Delta up\ max}$, than the occurrence of an event is likely.

Establishing $slope_{\Delta up\ max}$ is similar to establishing $\Delta_{max}$ and may be done through empirical testing to determine the optimum value for sensitive yet reliable results. In a preferred embodiment, $\Delta_{max}$ is substituted in Equation (11) and the resulting slope is $slope_{\Delta up\ max}$. For example, if $N_1$ is 10, $N_2$ is 100 and $\Delta_{max}$ is 5 gallons/minute, then $slope_{\Delta up\ max}$ would be (0.45 gallons/minute)/(change in N). Therefore, in this example, if the slope equals or exceeds 0.45 gallons/minute)/(change in N), then an event is likely to have occurred.

After it is determined that $slope_{\Delta up}$ is equal to or exceeds $slope_{\Delta up\ max}$, optional, additional statistical evaluations may be performed to ensure accuracy and to avoid a false positive indication of an event. One such statistical evaluation involves, again, the use of $t_{test}$. In this situation, $t_{test}$ may be determined using the following equation:

$$t_{test} = \frac{Slope_{\Delta\ up} - Slope_{\Delta\ up\ \max}}{\sigma_{Slope_\Delta}\sqrt{\frac{1}{N_i - N_o}}} \qquad \text{Equation (14)}$$

wherein $\sigma_{slope\ \Delta}$ represents the standard deviation for the Δs used in the calculation of $slope_\Delta$. If $t_{test}$ exceeds a predetermined value of $t_{test}$, $t_{max}$, then the certainty of an event is established at a particular confidence level. For example, a positive $t_{test}$ of over 2.94 indicates an event with 99% probability. The probability increases as successive, new $t_{test}$, that exceed $t_{max}$ are calculated (as described above).

Another approach to increase confidence that an event has occurred is to calculate successive values of $slope_{\Delta up}$s and determine if each successive value is equal to or exceeds $slope_{\Delta max}$. The probability of an event increases as the number of successive $slope_{\Delta up}$ values that exceed $slope_{\Delta max}$ increases. The optimum number of values considered for a particular confidence level can be determined by someone skilled in the art without undue experimentation.

Yet another approach to increase confidence that an event has occurred is to calculate not only the $slope_{\Delta up}$ but also $slope_{\Delta down}$. If the slope of Δs follows the theoretical down slope of Equation 12 after a period $N_1$ following the excessive Δ, then the occurrence of an event is almost certain. The down slope of Δ may calculated in accordance with the follow formula:

$$Slope_{\Delta_{down}} = \frac{\Delta_i - \Delta_{o+N_2}}{N_i - N_{o+N_i}} \qquad \text{Equation (15)}$$

The $slopes_{\Delta down}$ is compared to a down slope limit (herein "$slopes_{\Delta down\ max}$") If the value of the slope equals or exceeds $slope_{\Delta down\ max}$, than the occurrence of an event is likely. Like $slope_{max}$, $slope_{down\ max}$ can be determined by empirical means or by substituting $\Delta_{max}$ in Equation 12. For example, in the case where $N_1$ is 10, $N_2$ is 100 and $\Delta_{max}$ is 5 gallons/minute, then $slope_{\Delta down\ max}$ would be (0.1 gallons/minute)/(change in N). Therefore, in this example, if the slope equals or exceeds−0.1 gallons/minute)/(change in N), then an event is likely to have occurred.

The relationship of slopes down to $slope_{\Delta down\ max}$ is analogous to the relationship of $slope_{\Delta up}$ to $slope_{\Delta up\ max}$ in regard to the improving detection confidence levels. For example, $t_{test}$ may be calculated in accordance with Equation 14 modified for slopes down rather than $slope_{\Delta up}$.

It should be understood that a preferred embodiment of the invention involves a combination of the aforementioned techniques for evaluating Δ.

Indication of Event

Once the Δ is determined to be real and indicative of an event, such as a leak, an indication or warning is given to the user via the user interface. The indication of an event can be audio, visual or both. Moreover, in an embodiment using multiple window pairs, a different alarm condition can be indicated for a particular window pair. The severity of the alarm can be tailored to the length of the window indicating an event—the longer the window, the more urgent the warning.

Once a leak is detected, controller 336 (FIG. 3) in turn provides control signals to alarm 338 and, optionally, to a warning lamp 340. For shorter window pairs, the alarm indicate that a potential leak has been detected. This puts the operators on notice that a leak is likely, and affirmative action should be taken such as inspecting the boiler for confirmation. As the anomalous drum balance data subsequently affect the longer window pairs thereby triggering their alarms, the condition should be treated as much more serious. A long term alarm may require emergency action such as shutting off the feed water.

In one embodiment of the invention, the leak detection system not only signals an alarm condition, but also takes action to avert a catastrophic failure. Referring back to FIG. 5, controller 336 calculates leakage rate Δ for the next data set in Block 610, and for subsequent data sets. At the end of such calculations, controller 336 will determine if the calculated leakage rate Δ has increased with respect to previous measurements in Block 611. If Δ has not increased, the process is repeated. If Δ does increase, controller 336 then determines if a predetermined minimum time $T_B$ has elapsed in Block 612. If time equal to $T_B$ has not elapsed, the sampling and calculation process is again repeated. If a period of time greater than TB has elapsed, controller 336 in Block 613 will activate shutoff valve 342 in feed water line 318, to cut off feed water to the recovery boiler 314, thereby shutting down the recovery boiler system 312 automatically. Thus, if the leakage rate continues to increase over a predetermined period of time without human intervention, system 310 act to automatically prevent a leak created explosion from taking place in the recovery boiler system 12.

EXAMPLE

This example illustrates the practice of the present invention on a target system having equatable input(s) and output (s) such that a system balance (SB) can be drawn around it. As shown in Table 1, theoretical inputs (in) and outputs (out) were entered sequentially at various intervals (N). For simplicity, no units are assigned to the input and output. The output was subtracted from the input to calculate SB. Short and long term averages, $SB_1$ and $SB_2$, respectively, were calculated based upon a short term sampling, $N_1$, of 5, and a long term sampling, $N_2$, of 15. It should be noted that these samplings are typically longer, but were shorted herein to render the size of the example more manageable.

At interval 16, an event occurs wherein the output drops sharply to only about one (1) causing SB to increase dramatically. Initially, this change is realized to a greater extent by $SB_1$ than by $SB_2$ due to the greater impact the change has in the smaller sampling of $SB_1$. The difference in the averages is recorded as Δ.

A preferred embodiment of the present invention determines whether Δ is excessive before statistically evaluating it. In this case, a Δ of greater than 5 is considered excessive and will trigger the statistical evaluation of Δ to determine the likelihood of an event. Δ exceeds this limit at interval 19.

One approach to statistically evaluating Δ is to determine whether it is significant by calculating its $t_{test}$. In a preferred embodiment, this is performed at interval 19 (excessive Δ), however, if computational resources are not an issue, $t_{test}$ can be calculated for each Δ (as shown in Table 1). Determining $t_{test}$ first requires calculating the standard deviation for the short and long term averages, $\sigma_1$ and $\sigma_2$, respectively. A $t_{test}$ of 2.94 suggests a 99% likelihood that the event is real. Therefore, at interval 20, a determination is made that the occurrence of an event is extremely likely.

Another approach to the statistically evaluation of Δ comprises monitoring successive, significant Δs. In intervals 21 through 26, successive, significant As are calculated. This virtually assures that an event has occurred.

Yet another approach to evaluate Δ comprises monitoring the change in Δ. The change in Δ is calculated in terms of its slope using Equation (13) wherein $\Delta_o$ is assumed to be 0 prior to the event occurring. In this example, $N_o$ is taken at N=15, just prior to the event's occurrence. The slope of Δ immediately increases to about 1.5 and remains for a period equal to the number of values considered in the short term average, in this case, 5. A slope of 1.5 exceeds a maximum slope of ⅔ which is calculated using Equation (11) and a $\Delta_{max}$ of 5. The confidence level of an event detection can be increased by utilizing $t_{test}$, one equation for which is shown in Equation 14. As indicated in intervals 18 through 20, extremely high $t_{test}$s are calculated which virtually assures the probability of an event.

TABLE 1

STATISTICAL ANALYSIS OF EVENT IN TARGET SYSTEM

| N | In | Out | SB | $SB_1$ | $SB_2$ | Δ | $\sigma_1$ | $\sigma_2$ | $t_{test}$ | $Slope_{up}$ | $\sigma_{slope}$ | $t_{test}$ |
|---|---|---|---|---|---|---|---|---|---|---|---|---|
| 1 | 11 | 12 | −1.00 | — | | | | | | | | |
| 2 | 11 | 11 | 0.00 | — | | | | | | | | |
| 3 | 12 | 12 | 0.00 | | | | | | | | | |
| 4 | 12 | 12 | 0.00 | | | | | | | | | |
| 5 | 10 | 11 | −1.00 | −0.4 | | | 0.49 | | | | | |
| 6 | 11 | 10 | 1.00 | 0 | | | 0.63 | | | | | |
| 7 | 11 | 11 | 0.00 | 0 | | | 0.63 | | | | | |
| 8 | 12 | 12 | 0.00 | 0 | | | 0.63 | | | | | |
| 9 | 13 | 11 | 2.00 | 0.4 | | | 1.02 | | | | | |
| 10 | 11 | 12 | −1.00 | 0.4 | | | 1.02 | | | | | |
| 11 | 11 | 12 | −1.00 | 0 | | | 1.1 | | | | | |
| 12 | 10 | 10 | 0.00 | 0 | | | 1.1 | | | | | |
| 13 | 9 | 11 | −2.00 | −0.4 | | | 1.36 | | | | | |
| 14 | 10 | 10 | 0.00 | −0.8 | | | 0.75 | | | | | |
| 15 | 10 | 10 | 0.00 | −0.6 | −0.20 | −0.40 | 0.8 | 0.9 | −0.93 | | | |

TABLE 1-continued

STATISTICAL ANALYSIS OF EVENT IN TARGET SYSTEM

| N | In | Out | SB | $SB_1$ | $SB_2$ | Δ | $\sigma_1$ | $\sigma_2$ | $t_{test}$ | $Slope_{up}$ | $\sigma_{slope}$ | $t_{test}$ |
|---|---|---|---|---|---|---|---|---|---|---|---|---|
| 16 | 11 | 1 | 10.00 | 1.6 | 0.53 | 1.07 | 4.27 | 2.7 | 0.53 | 1.47 | ○ | ∞ |
| 17 | 12 | 1 | 11.00 | 3.8 | 1.27 | 2.53 | 5.53 | 3.7 | 0.95 | 1.47 | ○ | ∞ |
| 18 | 11 | 1 | 10.00 | 6.2 | 1.93 | 4.27 | 5.08 | 4.3 | 1.69 | 1.56 | 0.04 | 36.63 |
| 19 | 11 | 1 | 10.00 | 8.2 | 2.60 | 5.60 | 4.12 | 4.7 | 2.54 | 1.5 | 0.04 | 45.71 |
| 20 | 11 | 1 | 10.00 | 10.2 | 3.33 | 6.87 | 0.4 | 4.9 | 5.34 | 1.45 | 0.04 | 47.52 |
| 21 | 11 | 1 | 10.00 | 10.2 | 3.93 | 6.27 | 0.4 | 5.2 | 4.67 | −0.60 | | |
| 22 | 12 | 1 | 11.00 | 10.2 | 4.67 | 5.53 | 0.4 | 5.3 | 3.99 | −0.74 | | |
| 23 | 11 | 1 | 10.00 | 10.2 | 5.33 | 4.87 | 0.4 | 5.3 | 3.51 | −0.66 | | |
| 24 | 11 | 1 | 10.00 | 10.2 | 5.87 | 4.33 | 0.4 | 5.4 | 3.1 | −0.54 | | |
| 25 | 11 | 0 | 11.00 | 10.4 | 6.67 | 3.73 | 0.49 | 5.2 | 2.76 | −0.60 | | |
| 26 | 12 | 1 | 11.00 | 10.6 | 7.47 | 3.13 | 0.49 | 4.8 | 2.47 | −0.60 | | |
| 27 | 11 | 0 | 11.00 | 10.6 | 8.20 | 2.40 | 0.49 | 4.5 | 2.04 | −0.73 | | |
| 28 | 12 | 1 | 11.00 | 10.8 | 9.07 | 1.73 | 0.4 | 3.6 | 1.83 | −0.67 | | |
| 29 | 11 | 1 | 10.00 | 10.8 | 9.73 | 1.07 | 0.4 | 2.6 | 1.52 | −0.66 | | |
| 30 | 11 | 1 | 10.00 | 10.6 | 10.40 | 0.20 | 0.49 | 0.5 | 0.79 | −0.87 | | |
| 31 | 10 | 1 | 9.00 | 10.2 | 10.33 | −0.13 | 0.75 | 0.6 | −0.35 | −0.33 | | |
| 32 | 12 | 1 | 11.00 | 10.2 | 10.33 | −0.13 | 0.75 | 0.6 | −0.35 | 0.00 | | |
| 33 | 10 | 0 | 10.00 | 10 | 10.33 | −0.33 | 0.63 | 0.6 | −1.02 | −0.20 | | |
| 34 | 11 | 0 | 11.00 | 10.2 | 10.40 | −0.20 | 0.75 | 0.6 | −0.54 | 0.13 | | |
| 35 | 11 | 0 | 11.00 | 10.4 | 10.47 | −0.07 | 0.8 | 0.6 | −0.18 | 0.13 | | |
| 36 | 11 | 1 | 10.00 | 10.6 | 10.47 | 0.13 | 0.49 | 0.6 | 0.48 | 0.20 | | |
| 37 | 11 | 1 | 10.00 | 10.4 | 10.40 | 0.00 | 0.49 | 0.6 | 0 | −0.13 | | |
| 38 | 11 | 1 | 10.00 | 10.4 | 10.40 | 0.00 | 0.49 | 0.6 | 0 | 0.00 | | |
| 39 | 11 | 1 | 10.00 | 10.2 | 10.40 | −0.20 | 0.4 | 0.6 | −0.84 | −0.20 | | |
| 40 | 11 | 1 | 10.00 | 10 | 10.33 | −0.33 | 0 | 0.6 | −2.14 | −0.13 | | |

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method for detecting an occurrence of an event in a target system based upon sequentially recorded values of at least one operational variable of said target system, said operation variable providing an indication of one or more conditions of the target system which change in response to the event, said method comprising the steps of:

(a) calculating a pair of a short term average and a long term average of said values wherein said long term average includes values in addition to those included in said short term average;

(b) calculating the difference between said pair;

(c) reiterating steps (a) and (b) at least once wherein each reiterated pair of short and long term averages includes at least one value that is more recent Oman any value included in a previously calculated pair of short and long term averages; and (d) calculating the change in the differences calculated in step (b) over the change in the number of sequentially recorded values to determine slope and indicating the occurrence of an event if said slope exceeds a predetermined limit.

2. The method of claim 1, wherein in step (d) an event is indicated when said slope of the differences, $slope_{\Delta}$, exceeds $slope_{\Delta max}$ having the following formula:

$$SLOPE_{\Delta_{max}} = \frac{\frac{N_2 - N_1}{N_2} * \Delta_{max}}{N_1}$$

wherein $\Delta_{max}$ is a predetermined value representing the maximum tolerable difference between said long term and short term averages, $N_1$ represents the number of said values included in said short term average, and $N_2$ refers to the number of said valises included in said long term average.

3. The method of claim 2, wherein in step (d) an alarm condition is indicated when a $t_{test}$ value exceeds a predetermined value, said $t_{test}$ having the formula:

$$t_{test} = \frac{Slope_{\Delta} - Slope_{\Delta max}}{\sigma_{Slope_{\Delta}} \sqrt{\frac{1}{N_i - N_o}}}$$

wherein $\sigma_{\Delta}$ is the standard deviation for the Δs used to calculate said $slope_{\Delta}$.

4. The method of claim 1, wherein in step (a) more tar one pair of short and long term averages are calculated, each pair varying in the number of values included in at least the long term average.

5. The method of claim 3, wherein an indication of an event depends upon the number of values considered in the pair of short and long term averages used in determining the differential which indicates said event.

6. The method of claim 1, wherein said operational variable is a system balance.

7. The method of claim 6, wherein said target system is a boiler having equatable inputs and outputs such that a drum balance is determinable.

8. A method for detecting an occurrence of an event in a target system having at least one operational variable, said operation variable providing an indication of one or more conditions of the target system which change in response to the event, said method comprising the steps of:

sequentially recording values of said operational variable;

calculating a first short term average and a first long tern average by averaging a certain number, $N_1$ and $N_2$ respectively, of sequentially recorded values, said first short and long term averages including a common most recent first value;

calculating at least a second short tern average and a second long term average of $N_1$ and $N_2$ sequentially recorded values respectively, said second short and long term averages including a common most recent second value, wherein said second value is more recent than said first value;

calculating a first Δ between said first short and long term averages and a second Δ between said second short and long term averages; and determining the change in Δ between said first and second Δs over the change in the number of sequentially recorded values to determine a first slope and indicating an event if said first slope exceeds a predetermined first limit.

9. The method of claim 8, said process further comprising:

calculating at least a third short term average and at least a third long term average by averaging a certain number, $N_1$, and $N_2$, respectively, of sequentially recorded values, wherein said $N_1$, and $N_2$. are different from said $N_1$ and $N_2$ respectively, said third short and long term averages including a common most recent third value;

calculating at least a fourth short term average and a fourth long tern average of $N_1$, and $N_2$, sequentially recorded values respectively, said second short and long term averages including a common most recent fourth value wherein said fourth value is more recent than said third value;

calculating a third Δ between said third short and long term averages and a fourth Δ between said fourth short and long term averages; and determining the change in Δ between said third and fourth Δs over the change in the number of sequentially recorded values to determine a second slope and indicating an event if said second slope exceeds a predetermined second limit.

10. The method of claim 9, wherein a first indication is provided if said first slope exceeds said first limit, and a second indication is provided if said second slope exceeds said second limit.

11. A system for detecting an occurrence of an event in a target system having at least one operational variable that provides an indication of one or more conditions of the target system which change in response to the event, said system comprising:

(a) means for calculating a pair of a short term average and a long term average of said values wherein said long term average includes values in addition to those included in said short term average;

(b) means for calculating the difference between said pair;

(c) means for reiterating steps (a) and (b) at least once wherein each reiterated pair of short and long term averages includes at least one value that is more recent than any value included in a previously calculated pair of short and long term averages; and (d) means for calculating the change in the differences calculated in step (b) over the change in the number of sequentially recorded values to determine slope and indicating the occurrence of an event if said slope exceeds a predetermined limit.

* * * * *